US006296144B1

(12) United States Patent
Tanaka et al.

(10) Patent No.: US 6,296,144 B1
(45) Date of Patent: Oct. 2, 2001

(54) WET TISSUE PACKAGE

(75) Inventors: Yoshikazu Tanaka; Mitsuko Yamaji, both of Kagawa (JP)

(73) Assignee: Uni-Charm Corporation, Kawanoe (JP)

( * ) Notice: Subject to any disclaimer, the term of this patent is extended or adjusted under 35 U.S.C. 154(b) by 0 days.

(21) Appl. No.: 09/520,324

(22) Filed: Mar. 7, 2000

(30) Foreign Application Priority Data

Mar. 30, 1999 (JP) ..... 11-089493

(51) Int. Cl.[7] ..... A47K 10/24
(52) U.S. Cl. ..... 221/45; 206/494
(58) Field of Search ..... 221/33, 45, 46, 221/48, 49, 50, 63; 206/494, 812, 223, 581

(56) References Cited

U.S. PATENT DOCUMENTS

| | | | |
|---|---|---|---|
| 3,490,645 | 1/1970 | Glass et al. | 221/48 |
| 5,242,057 | 9/1993 | Cook et al. | 206/581 |
| 6,109,430 * | 8/2000 | Bando et al. | 221/48 |

FOREIGN PATENT DOCUMENTS

| | | |
|---|---|---|
| 2436645 A1 | 3/1975 | (DE) . |
| 9106555 | 5/1991 | (DE) . |

* cited by examiner

*Primary Examiner*—Kenneth W. Noland
(74) *Attorney, Agent, or Firm*—Darby & Darby

(57) ABSTRACT

There is disclosed a wet tissue package including a plurality of rectangular or square wet tissues which are individually folded and are stacked in a bag-shaped or container-shaped packaging material of which an upper face is formed with an opening for taking out the wet tissues therethrough one by one. In this wet tissue package, each of the wet tissue is double-folded on a first folding line (L1), and further folded at least on second, third and fourth folding lines (L2, L3 and L4). The first folding line (L1) appears in the opening of the packaging material. Alternatively, if a portion folded on the second folding line (L2) and laid over the upper side of the double-folded wet tissue is further folded on a sixth folding line (L6), at least one of the first folding line (L1) and the sixth folding line (L6) appears in the opening of the packaging material. When the wet tissue is pinched and pulled up at the first folding line (L1) or at the sixth folding line (L6), it is opened out into the double-folded state or into such a state that the double-folded wet tissue is folded on the sixth folding line (L6). Therefore, the wet tissue can be used for wiping excrements or the like at least in the double-folded state, immediately after taken out from the packaging material.

26 Claims, 8 Drawing Sheets

WET TISSUE PACKAGE

BACKGROUND OF THE INVENTION

1. Field of the Invention

The present invention relates to a package in which wet tissues are accommodated. More particularly, the present invention relates to a portably compact wet tissue package from which wet tissues can be taken out one by one in a folded state.

2. Related Art

Wet tissues are widely used for wiping the rear of a baby or child at the time of changing a diaper. Such wet tissues are made of non-woven fabrics impregnated with water or chemicals and are individually folded. Then, the folded wet tissues are stacked and accommodated in a bag-shaped or container-shaped packaging material, so that they can be taken out one by one for use from an opening formed in the upper face of the packaging material.

However, because such a wet tissue is made so thin, materials to be cleaned such as excrements are liable to pass through the wet tissue to soil the hands, when used for wiping the rear or the like in its opened out state. At the time of wiping the excrements or the like, therefore, the wet tissue taken out from the packaging material is first opened out by hand and is then folded into a preferable size for use, for example, into two or four. However, it is extremely inconvenient to open out the wet tissue for changing its folding size.

Moreover, it is preferable that the wet tissue of this kind can be carried while being accommodated in a small-sized, bag-shaped packaging material. In order to fold and accommodate one wet tissue in the small packaging material, however, the area of the wet tissue has to be reduced. If such a small wet tissue is folded into two for wiping, it becomes so small that the hand is easily soiled with the materials to be cleaned such as excrements.

On the other hand, when a wet tissue having a large area is to be folded so compact as to fit the small-sized packaging material, it has to be multi-folded in a seriously complex manner. In this case, the wet tissues are liable to be wrinkled, when taken out one by one from the opening. Therefore, it is so laborious to open it out before the folding for use.

SUMMARY OF THE INVENTION

The invention has been conceived to solve the aforementioned problems of the prior art and has an object to provide a wet tissue package which allows the use in a double-folded state without the folding operation to be done by the user of the prior art and which can compactly accommodate wet tissues even though they have a large area in an opened out state.

According to a first aspect of the invention, there is provided a wet tissue package comprising a plurality of rectangular or square wet tissues which are individually folded and are stacked in a bag-shaped or container-shaped packaging material of which an upper face is formed with an opening for taking out the wet tissues therethrough one by one, wherein each of the wet tissues is folded on a first folding line (L1) into a double-folded state, the double-folded wet tissue is folded on a second folding line (L2) so that the first folding line (L1) is laid over an upper side of the double-folded wet tissue; folded on a third folding line (L3) so that side edges (11*b*) opposed to the first folding line (L1) are laid over a back side of the double-folded wet tissue; and then folded on a fourth folding line (L4) perpendicular to the first folding line (L1) so that the back side becomes a valley side, and the wet tissue after being folded on the fourth folding line (L4) is accommodated in the packaging material with the upper side thereof directed toward the upper face of the packaging material so that the first folding line (L1) appearing on the upper side of the wet tissue is exposed in the opening of the packaging material.

According to a second aspect of the invention, there is provided a wet tissue package comprising a plurality of rectangular or square wet tissues which are individually folded and are stacked in a bag-shaped or container-shaped packaging material of which an upper face is formed with an opening for taking out the wet tissues therethrough one by one, wherein each of the wet tissues is folded on a first folding line (L1) into a double-folded state, the double-folded wet tissue is folded on a second folding line (L2) so that the first folding line (L1) is laid over an upper side of the double-folded wet tissue; folded on a sixth folding line (L6) located between the first folding line (L1) and the second folding line (L2) so that the first folding line (L1) is positioned above the second folding line (L2); folded on a third folding line (L3) so that side edges (11*b*) opposed to the first folding line (L1) are laid over a back side of the double-folded wet tissue; and then folded on a fourth folding line (L4) perpendicular to the first folding line (L1) so that the back side becomes a valley side, and the wet tissue after being folded on the fourth folding line (L4) is accommodated in the packaging material with the upper side thereof directed toward the upper face of the packaging material so that at least one of the first folding line (L1) and the sixth folding line (L6) appearing on the upper side of the wet tissue is exposed in the opening of the packaging material.

According to the invention, the wet tissue can be taken out from the packaging material by pinching the first folding line (L1) or the sixth folding line (L6) appearing in the opening of the packaging material. Therefore, the wet tissue can be used for wiping excrements or the like in its double-folded state on the first folding line (L1) or in such a state that the double-folded wet tissue is further folded on the sixth folding line (L6), with no need to fold the wet tissue taken out from the packaging material.

Moreover, because the wet tissue is folded intending that it is used as folded at least on the first folding line (L1), it can be accommodated compactly in a small-sized packaging material even though it has a wide area in the opened out state.

To accommodate the wet tissue compactly in the packaging material, it is preferable that the double-folded wet tissue has substantially one half of the area of the wet tissue in its opened out state. Alternatively, it is preferable that the double-folded wet tissue is further folded such that either of two folded portions is folded on another folding line (L7 or L8), to thereby have at most one half (more preferably, less than one half) of the area of the wet tissue in the opened out state.

Preferably, the first folding line (L1) or the sixth folding line (L6) is located substantially at a center between the second folding line (L2) and the third folding line (L3). With such arrangement, the wet tissues can be taken out one by one easily from the opening, which is located at a general center or close to one side of the upper face of the packaging material.

Preferably, a portion folded on the third folding line (L3) and laid over the back side is further folded on a fifth folding line (L5). This can make the wet tissue package more compact.

In the wet tissue in the opened out state, if the difference between a length (a) of the side edge (11*a*) perpendicular to the first folding line (L1) and a length (b) of the side edge (11*b*) parallel to the first folding line (L1) is 30 mm or more, it is preferable that (a)>(b). On the other hand, if the difference between the length (a) and the length (b) is less than 30 mm, (a)>(b), (a)<(b) or (a)=(b) are all acceptable.

DESCRIPTION OF THE PREFERRED EMBODIMENTS

The invention will be described with reference to the accompanying drawings.

Figure 1:
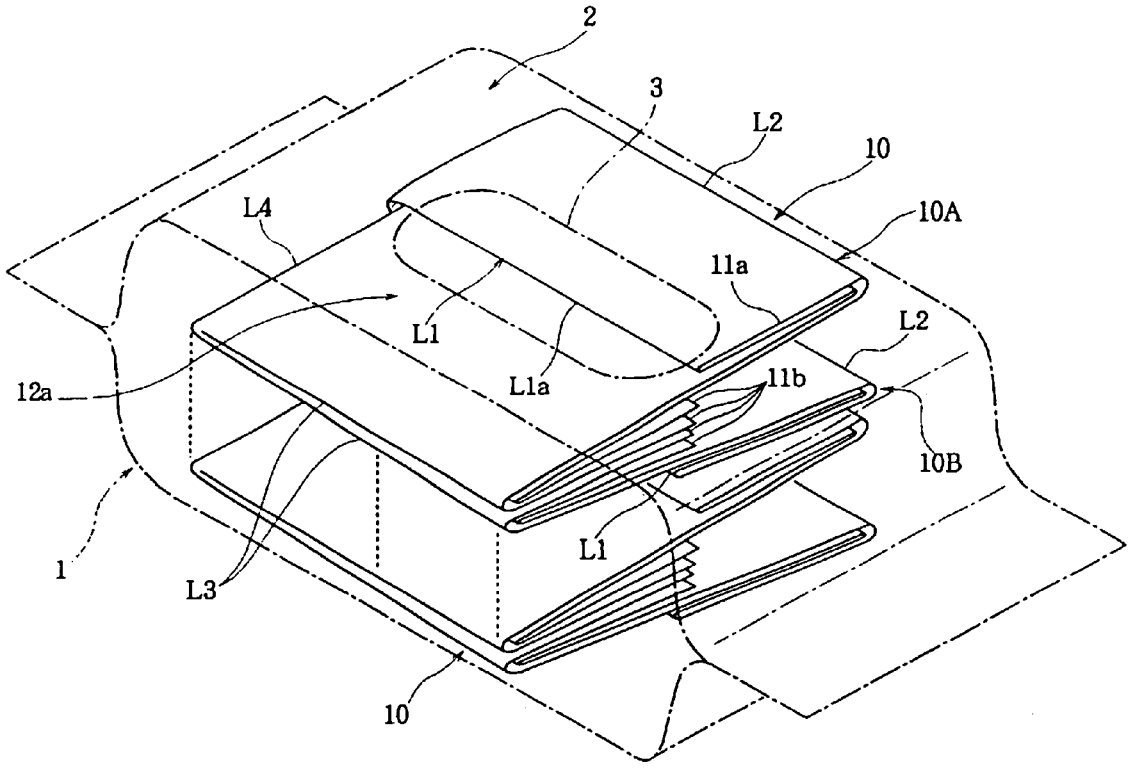
FIG. 1 is a perspective view of a wet tissue package according to a first embodiment of the invention.

FIG. 1 is a perspective view showing a wet tissue package of the invention; FIGS. 2 and 3 are perspective views sequentially showing the folded state of a wet tissue to be stacked in a packaging material shown in FIG. 1; and FIG. 4 is a perspective view showing the action to pull out the wet tissue from the packaging material.

In the wet tissue package shown in FIG. 1, a plurality of folded sheets 10 of wet tissues 11 are stacked and accommodated in a bag-shaped packaging material 1, as indicated by single-dotted lines. The term "folded sheet" as used herein means a wet tissue folded into a state to be accomedated in the packaging material. Here, only the uppermost and lowermost of the folded sheets 10 are shown with the intermediate ones being omitted.

The packaging material 1 is made of a laminate film in which, for example, a polyethylene terephthalate (PET) film, an aluminum foil and a heat-sealing biaxially oriented polypropylene (CPP) film, often called "sealant", are laminated sequentially in the recited order from the upper surface (or outer side) and are adhered to each other. Alternatively, the packaging material 1 may be prepared by adhering a heat-sealing film to a PET film having aluminum, silica or alumina deposited thereon.

The contents or the wet tissues 11 are enveloped with the laminate film with its heat-sealing film being directed inward of the packaging material 1. The laminate film is bonded by heat sealing longitudinally into a cylindrical shape, and is then bonded by heat sealing horizontally to complete the bag-shaped packaging material 1.

This bag-shaped packaging material 1 is made portable and has a generally flattened upper face 2 in which an opening 3 is formed. In this packaging material 1, a cover (omitted in Figures) for closing the opening 3 is adhered to the surface of the upper face 2. When the wet tissue package of the invention is not used, i.e., when it is before and after use, the packaging material 1 is sealed by closing the opening 3 with the aforementioned cover so that the wet tissues can be prevented from drying up. In use, on the other hand, the cover is peeled off to take out the wet tissues one by one from the opening 3.

The wet tissue 11 is made of, for example, a bulky non-woven fabric having a base weight of about 30 to 60 g/m$^2$. Such non-woven fabric is suitable for wiping the rear of a baby or child when a diaper is to be replaced or for cleaning the rear, private parts, hands or legs of an adult. Preferably, the wet tissue is made of a spun-lace non-woven fabric which is prepared by forming a fiber web of pulp and rayon in a wet method and by subjecting it to a water jetting treatment. The fiber web may contain other materials, if necessary. The non-woven fabrics thus obtained are impregnated with water or chemicals and accommodated in the packaging material 1. The wet tissues 11 have a size where "b"=140 to 150 mm and "a"=180 to 205 mm, for example.

Here will be described the folded structure of the folded sheets 10 of the aforementioned wet tissue 11.

Figure 2A:
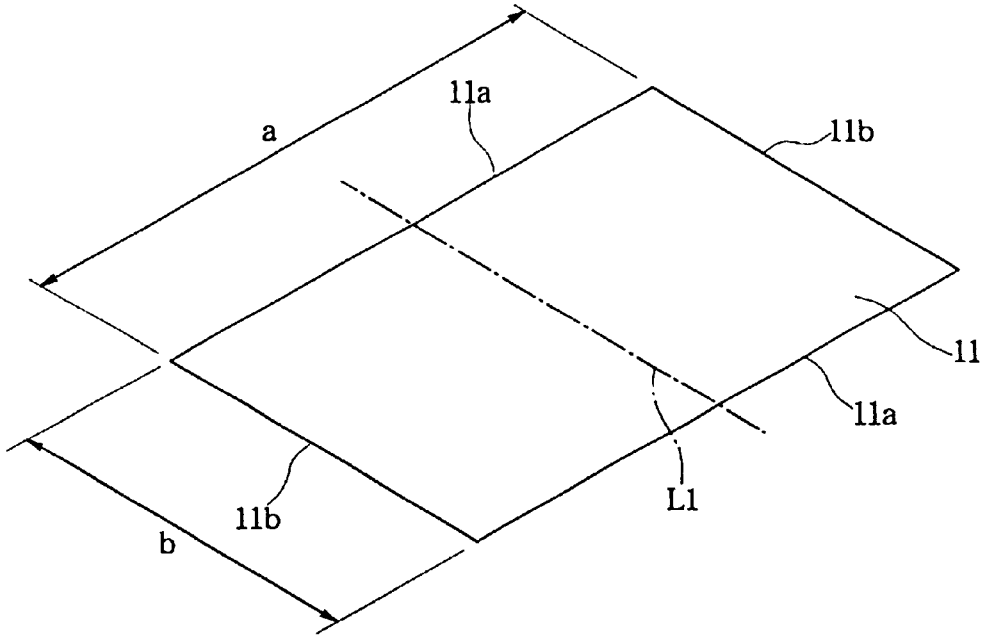
FIGS. 2(A) and 2(B) are perspective views showing the folding sequence in the first embodiment of the invention.

FIG. 2(A) shows one wet tissue 11 in an opened out state. This wet tissue 11 is folded on a first folding line L1 into two. The side edge (i.e., the shorter side of a rectangular wet tissue) 11*b* in parallel with the first folding line L1 has the width "b", and the side edge (i.e., the longer side of the rectangular wet tissue) 11*a* perpendicular to the first folding line L1 has the length "a". The resulting tissue folded into two is referred to as a double-folded tissue 12.

Figure 2B:
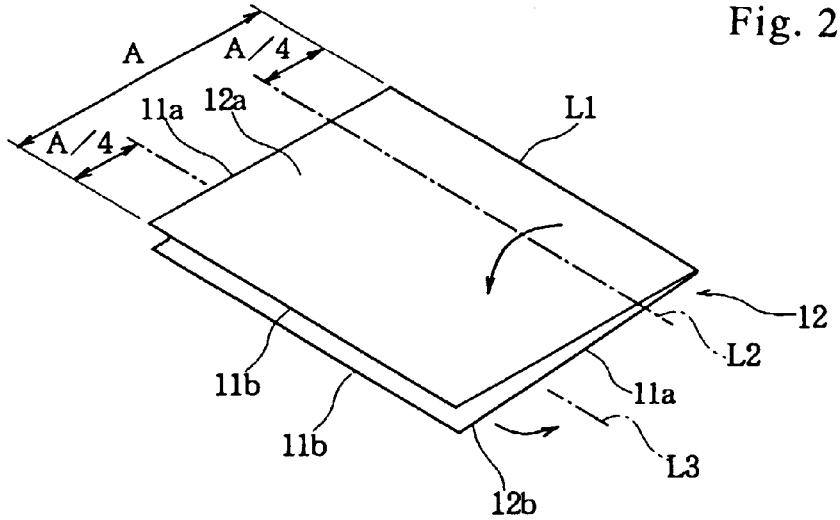

In FIG. 2(B), there is shown the double-folded tissue 12. The first folding line L1 is disposed to intersect each side edge 11*a* at the middle of the length "a" of the side edge 11*a*. In the double-folded tissue 12 shown in FIG. 2(B), therefore, not only the side edges 11*b* and 11*b* but also the side edges 11*a* and 11*a* are completely aligned so that the double-folded tissue 12 has one half of the area of the wet tissue 11 in the opened out state, as shown in FIG. 2(A). In the invention, however, the alignments between the side edges 11*a* and 11*a* and between the side edges 11*b* and 11*b* may be slightly offset. In this case, the double-folded tissue 12 shown in FIG. 2(B) has substantially one half of the area of the wet tissue 11 in the opened out state shown in FIG. 2(A).

In the double-folded tissue 12 shown in FIG. 2(B), the upper side is referred to as an upper surface 12*a* whereas the lower side is referred to as a back surface 12*b*. This folded tissue 12 of FIG. 2(B) is folded on a second folding line L2 spaced a predetermined distance (preferably, a quarter of the width "A" of the side of the double-folded tissue 12) apart from the aforementioned first folding line L1, so that the first folding line L1 is laid over the upper surface 12*a* of the double-folded tissue 12. In addition, the folded tissue 12 is folded on a third folding line L3 spaced a predetermined distance (preferably, "A"/4) apart from the side edges 11*b* and 11*b*, as opposed to the first folding line L1, so that the side edges 11*b* and 11*b* are laid over the back surface 12*b* of the double-folded tissue 12. The resulting tissue is shown in FIG. 3(A) and is referred to as a Z-folded tissue 13.

Figure 3A:
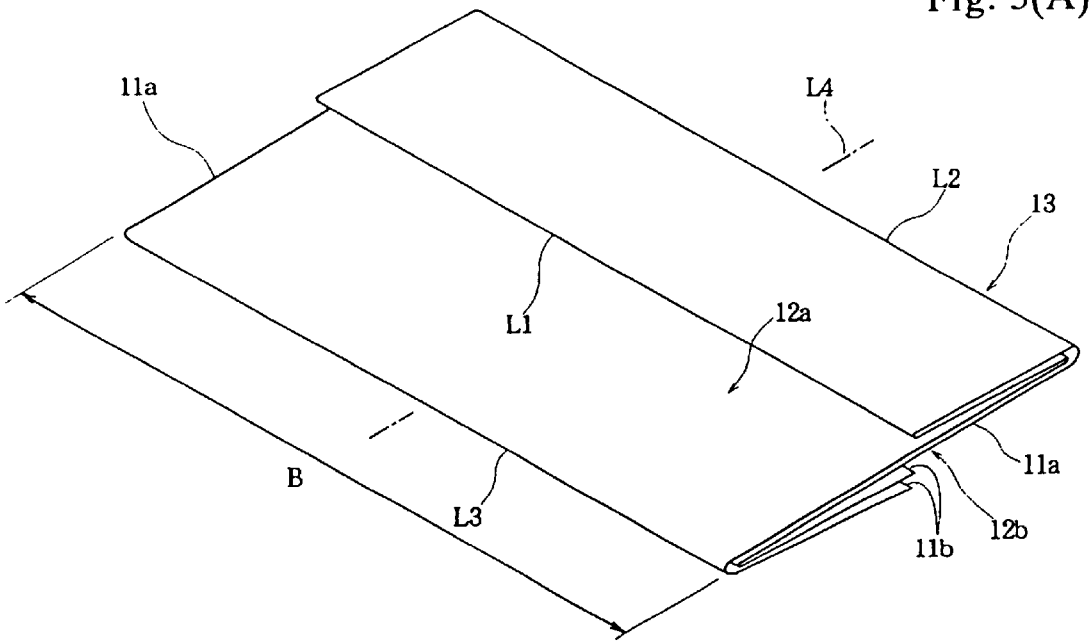
FIGS. 3(A) and 3(B) are perspective views showing the folding sequence in the first embodiment of the invention.
Figure 4:
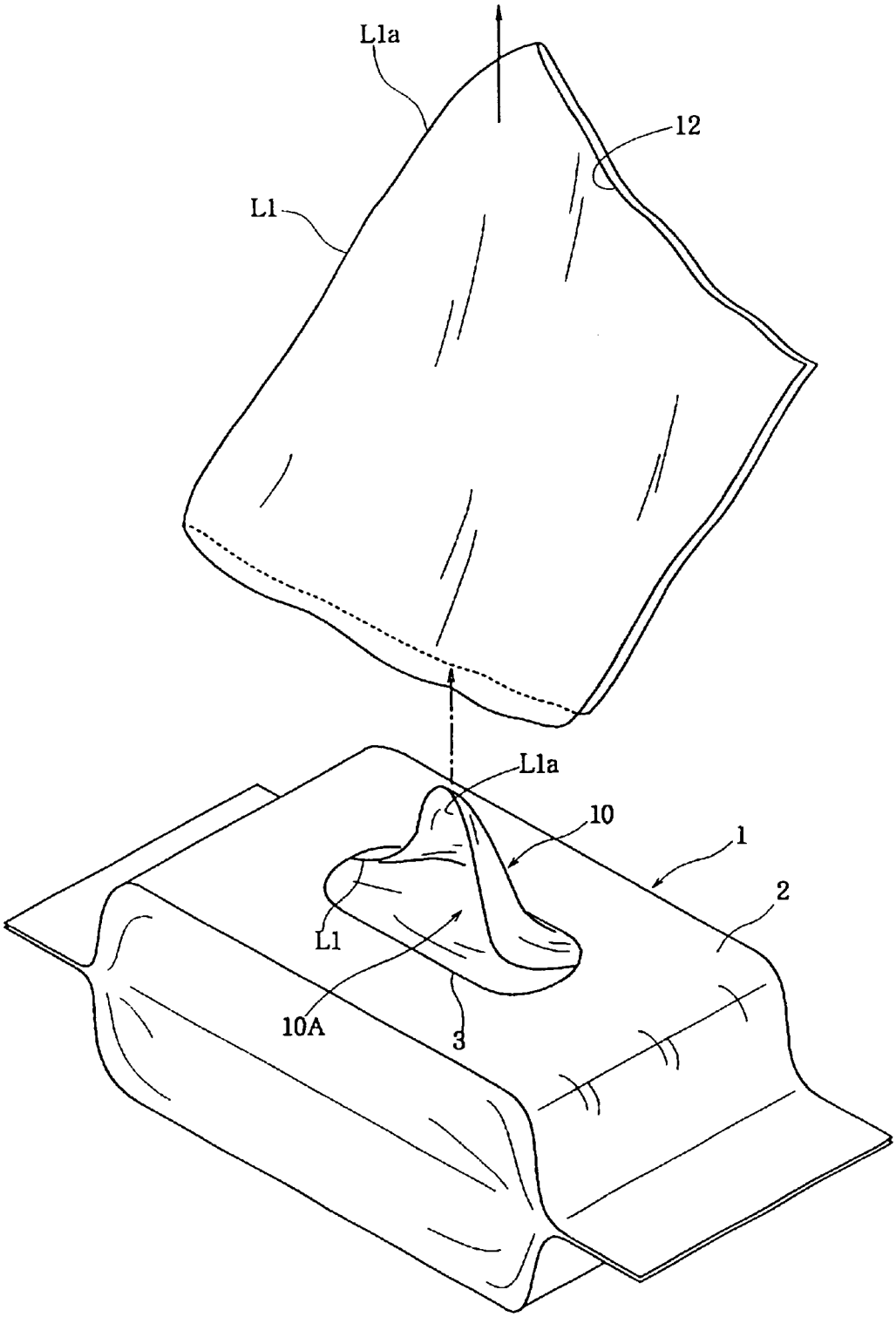
FIG. 4 is a perspective view showing the action to take out a wet tissue from a packaging material.

The Z-folded tissue 13 shown in FIG. 3(A) is further folded into two on a fourth folding line L4 extending roughly through the middle of the length "B" of its longer side. By this folding, the Z-folded tissue 13 has its valley on the side of the back surface 12*b* of the aforementioned double-folded tissue 12. Across the fourth folding line L4, the upper folded portion is designated by 10A, and the lower folded portion is designated by 10B. These upper and lower folded portions 10A and 10B are substantially aligned to form the folded sheet 10 in a state for storage.

In this folded sheet 10, the first folding line L1 extends roughly through the middle of the side having a width "C".

As shown in FIG. 1, the folded sheet 10 of the wet tissue 11 is so accommodated in the packaging material 1 that its upper folded portion 10A is directed toward the upper face 2 of the packaging material 1 and that an overhanging portion L1*a* of the first folding line L1 near the side edge 11*a* (or a half portion of the first folding line L1 on upper folded portion 10A) appears generally at the center of the opening 3.

As shown in FIG. 4, the overhanging portion L1*a* of the first folding line L1, as appearing in the opening 3 of the upper face 2 of the packaging material 1, is pinched and pulled out upward. At this time, the upper folded portion 10A is pulled up. As this pulling-up is continued, the upper folded portion 10A and the lower folded portion 10B are vertically extended. Also, the Z-fold is loosened. As a result, as shown in the upper portion of FIG. 4, the wet tissue 11 is taken out in the state of the double-folded tissue 12 in FIG. 2(B).

Therefore, the wet tissue 11 can be used for wiping in the state where it is folded in advance on the first folding line L1, immediately after the takeout. That is, material to be cleaned is wiped by a double-ply wet tissue, without the folding operation. Also, the wet tissue, as taken out in the state shown in FIG. 4, can be used for wiping in four-ply by folding it only one time.

Figure 3B:
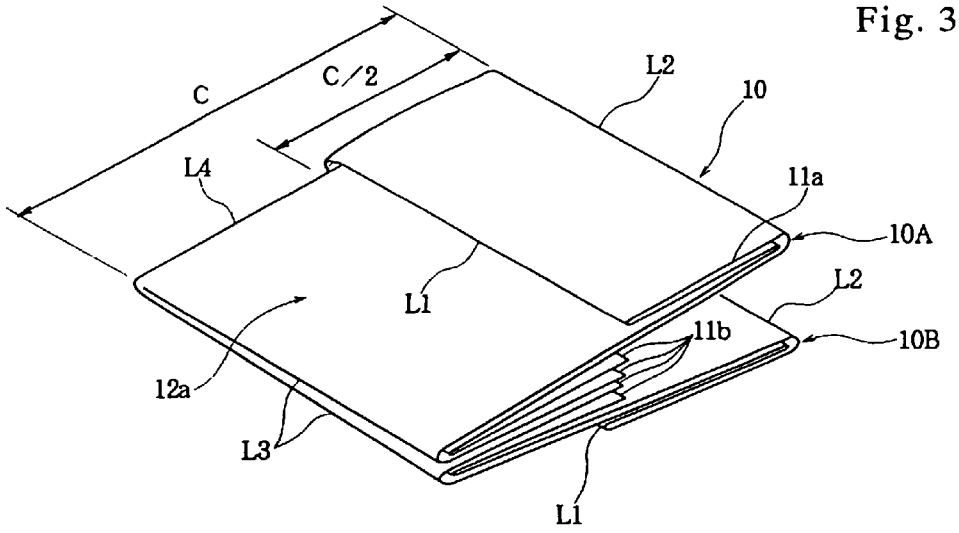

In this embodiment, the folded sheet 10 of FIG. 3(B) has about one half of the area of the Z-folded tissue 13 of FIG. 3(A). The Z-folded tissue 13 of FIG. 3(A) has about one half of the area of the double-folded tissue 12 of FIG. 2(B). The double-folded tissue 12 of FIG. 2(B) has about one half of the area of the wet tissue 11 in the opened out state of FIG. 2(A). As a result, the folded sheet 10 of FIG. 3(B) has one eighth of the area of the wet tissue 11 in the opened out state of FIG. 2(A). That is, the folded sheet 10 has one eighth of the original area of the wet tissue 11. Thus, the wet tissue 11 can be accommodated in the packaging material 1 so compactly as to have one eighth of its original area, while it can be used immediately after takeout to have one half of its original area which is sufficiently wide for wiping the material to be cleaned.

Figure 5:
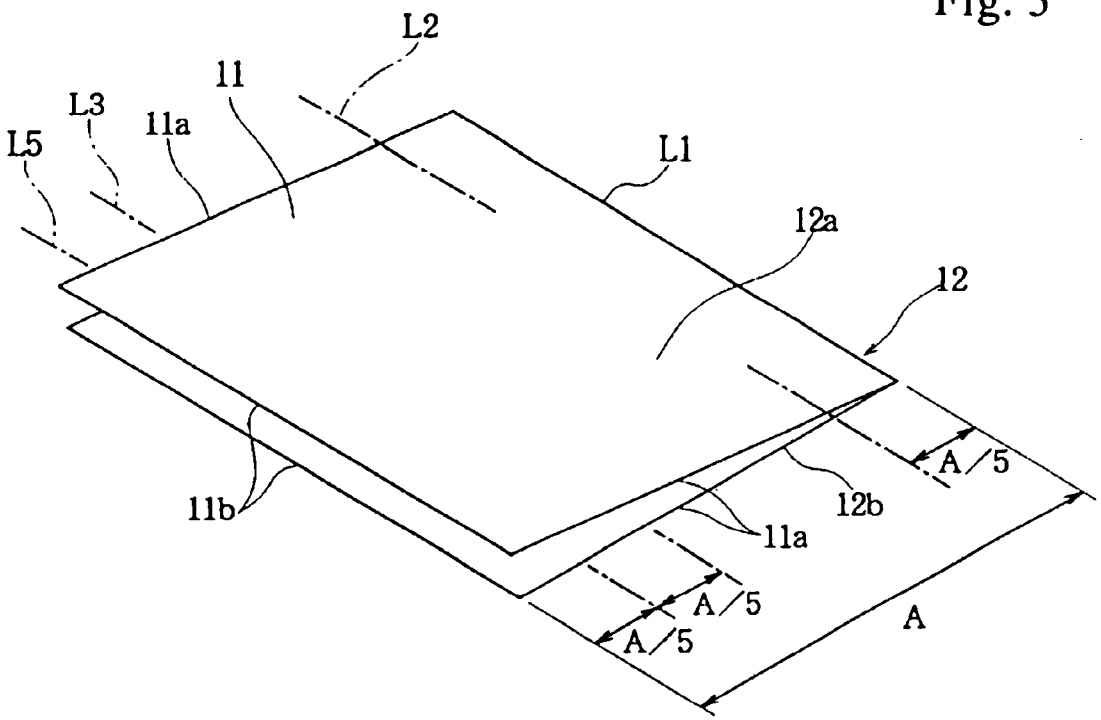
FIG. 5 is a perspective view showing the folding sequence in a second embodiment of the invention.
Figure 6A:
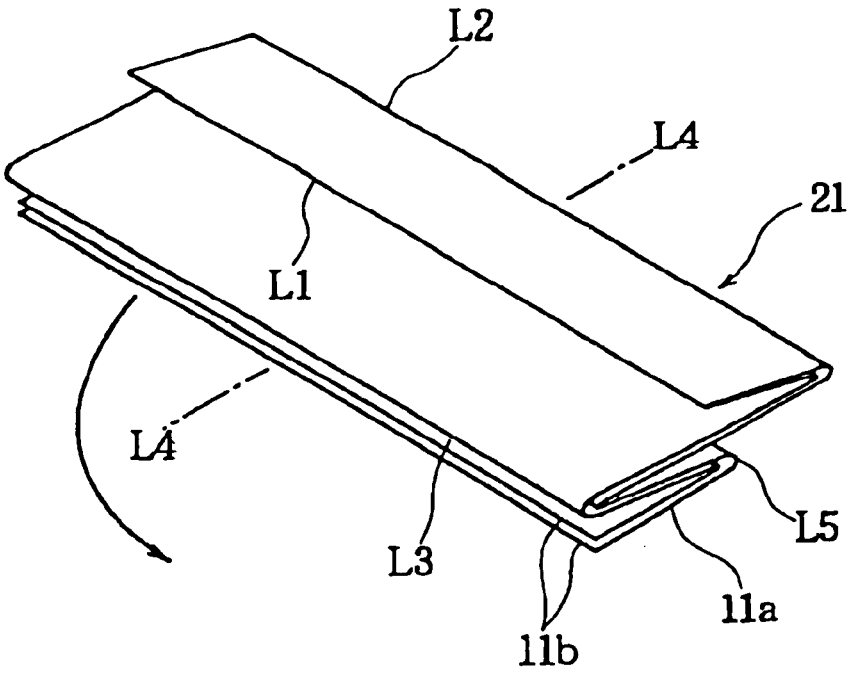
FIGS. 6(A) and 6(B) are perspective views showing the folding sequence in the second embodiment of the invention.

FIGS. 5 and 6 show a folding sequence for preparing a folded sheet of a wet tissue according to a second embodiment of the invention.

FIG. 5 shows the double-folded tissue 12 identical to that shown in FIG. 2(B). This double-folded tissue 12 is prepared by folding the wet tissue 11 on the first folding line L1 so that it has one half or about one half of the area of the wet tissue 11.

This double-folded tissue 12 is folded on the second folding line L2 which is spaced one fifth of the width "A" of its one side apart from the first folding line L1 so that the first folding line L1 is laid over the upper surface 12*a* of the double-folded tissue 12. On the other hand, the third folding line L3 is spaced two fifths (2/5) of the width "A" apart from the side edges 11*b* opposed to the first folding line L1 so that the side edges 11*b* are laid over the back surface 12*b* of the double-folded tissue 12. This double-folded tissue 12 is further folded on a fifth folding line L5 which is spaced one fifth of the width "A" apart from the side edges 11*b* so that the side edges 11*b* are aligned correctly or generally with the third folding line L3 to form a modified Z-folded tissue 21 shown in FIG. 6(A). This modified Z-folded tissue 21 is folded into two on the fourth folding line L4 which is set at one half of the longer side thereof, so that a folded sheet 20 shown in FIG. 6(B) is formed.

Figure 6B:
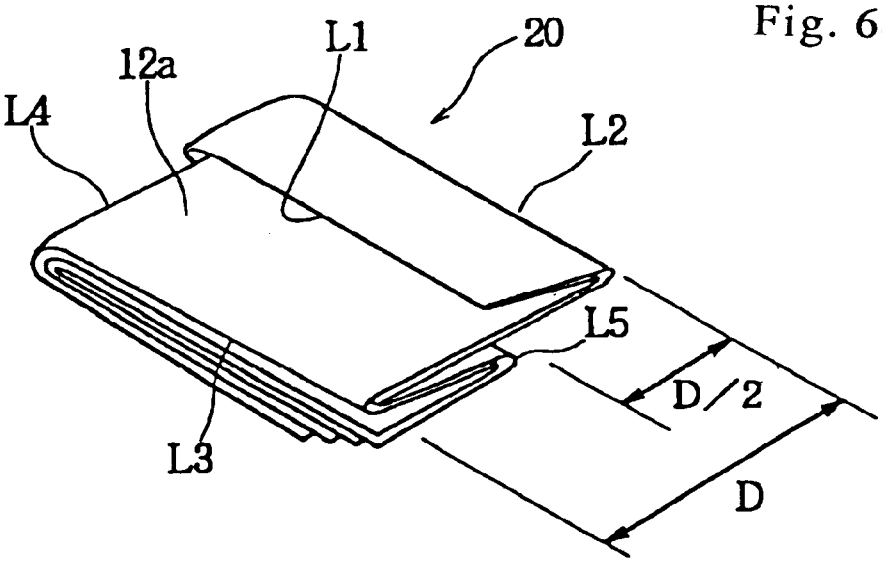

The folded sheet 20 shown in FIG. 6(B) has one tenth of the area of the wet tissue 11 in the opened out state in FIG. 2(A) so that it can be made remarkably compact. In the folded sheet 20 shown in FIG. 6(B), also, the first folding line L1 appears on its upper folded portion to extend through the middle of the side having a width "D".

The folded sheet 20 shown in FIG. 6(B) is accommodated in the packaging material 1 having the same structure as that shown in FIG. 1, so that the first folding line L1 appears at the center of the opening 3. When the first folding line L1 appearing in the opening 3 is pulled up, the folded state on the fourth folding line L4 is opened out and the modified Z-fold state is also opened out. Thus, the wet tissue 11 is taken out in the state of the double-folded tissue 12.

Figure 7:
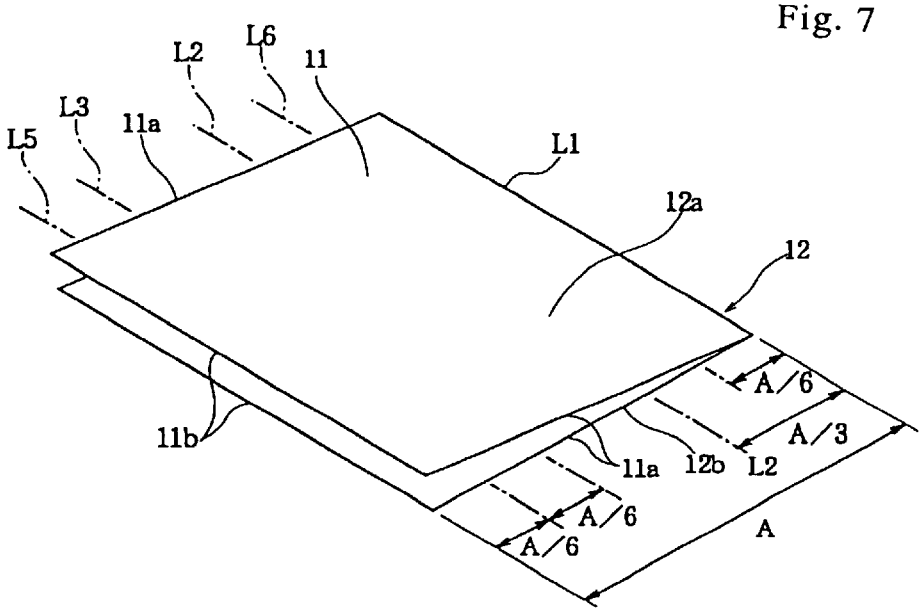
FIG. 7 is a perspective view showing the folding sequence in a third embodiment of the invention.

FIGS. 7 and 8 show a folding sequence for forming a folded sheet of wet tissue according to a third embodiment of the invention.

FIG. 7 shows the double-folded tissue 12 which is formed by folding the wet tissue 11 into two on the first folding line L1. The double-folded tissue 12 has one half or about one half of the original area of the wet tissue 11.

Figure 8A:
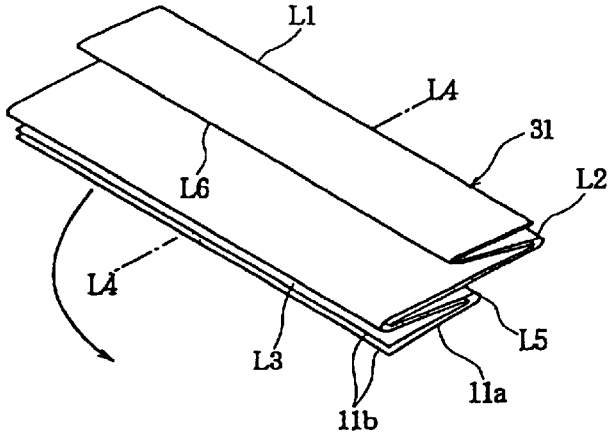
FIGS. 8(A) and 8(B) are perspective views showing the folding sequence in the third embodiment of the invention.

As shown in FIG. 8(A), the double-folded tissue 12 is folded on the second folding line L2, which is spaced one third of the width "A" apart from the first folding line L1, and is then folded upward on a folding line (or a sixth folding line) L6 which is located at the center between the first folding line L1 and the second folding line L2, so that the first folding line L1 is aligned with the second folding line L2. As a result, the folding line L6 is positioned over the upper surface 12a of the double-folded tissue 12.

Moreover, the double-folded tissue 12 is folded on the third folding line L3, which is spaced two sixths (or one third) of the width "A" apart from the side edges 11*b* opposed to the first folding line L1, and is then folded downward on the fifth folding line L5 which is spaced one sixth of width "A" apart from the side edges 11*b* (or set at the center between the third folding line L3 and the side edges 11*b*), so that the side edges 11*b* are aligned correctly or roughly with the third folding line L3. In such manner, there is formed a WZ-folded tissue 31, as shown in FIG. 8(A). This WZ-folded tissue 31 is folded into two on the fourth folding line L4 which is set to extend through the middle of the longer side of the WZ-folded tissue 31, to form a folded sheet 30 shown in FIG. 8(B).

Figure 8B:
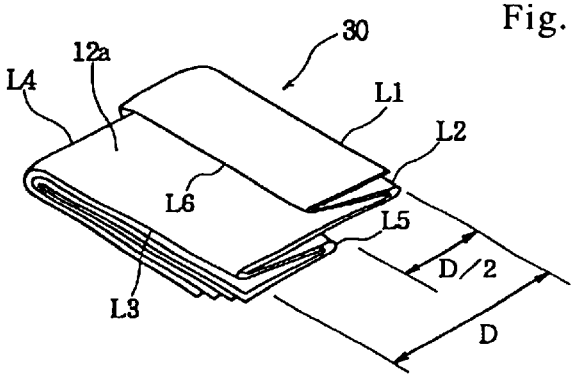

The folded sheet 30 shown in FIG. 8(B) has one twelfth of the area of the wet tissue 11 in the opened out state in FIG. 2(A) so that it can be made remarkably compact. In the folded sheet 30 shown in FIG. 8(B), also, the folding line L6 appears on its upper folded portion to extend through the middle of the side having a width "D".

The folded sheet 30 shown in FIG. 8(B) is accommodated in the packaging material 1 having the same structure as that shown in FIG. 1, so that the folding line L6 appears at the center of the opening 3. When the folding line L6 appearing in the opening 3 is pulled up, the folded state on the fourth folding line L4 is opened out and the WZ-fold state is almost opened out (the fold state on the folding line L6 is not opened). Thus, the wet tissue 11 is taken out in a state almost similar to the double-folded tissue 12.

The opening 3 may be formed to one side of the upper face 2 of the packaging material 1, so that the first folding line L1 of the folded sheet 30 appears in the opening 3. In this case, the wet tissue 11 can be taken out in the state of double-folded tissue 12. The opening 3 may be formed such that both the first folding line L1 and the folding line L6 appear in the opening 3. In this case, either the folding line L1 or L6 may be selected to pull out.

Figure 9A:
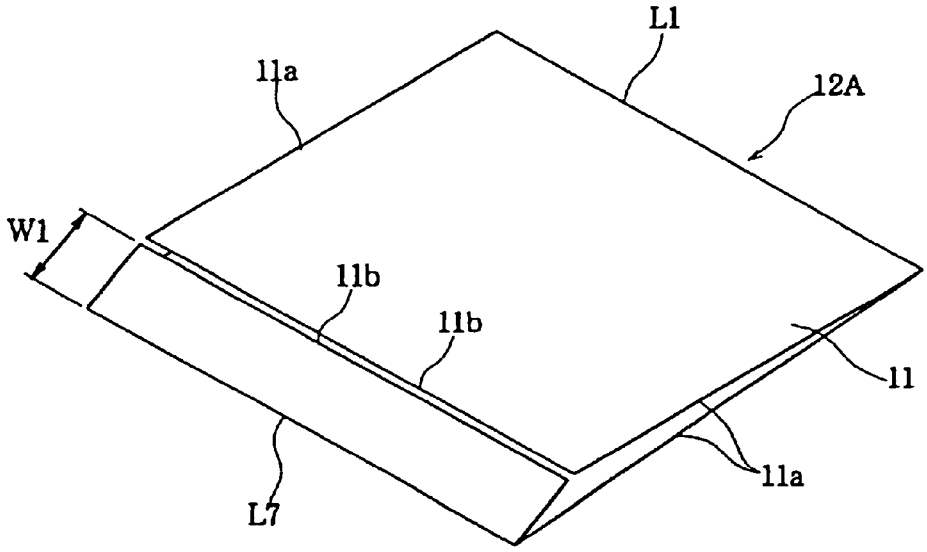
FIGS. 9(A) and 9(B) are perspective views showing modifications of a folded tissue folded on a first folding line.
Figure 9B:
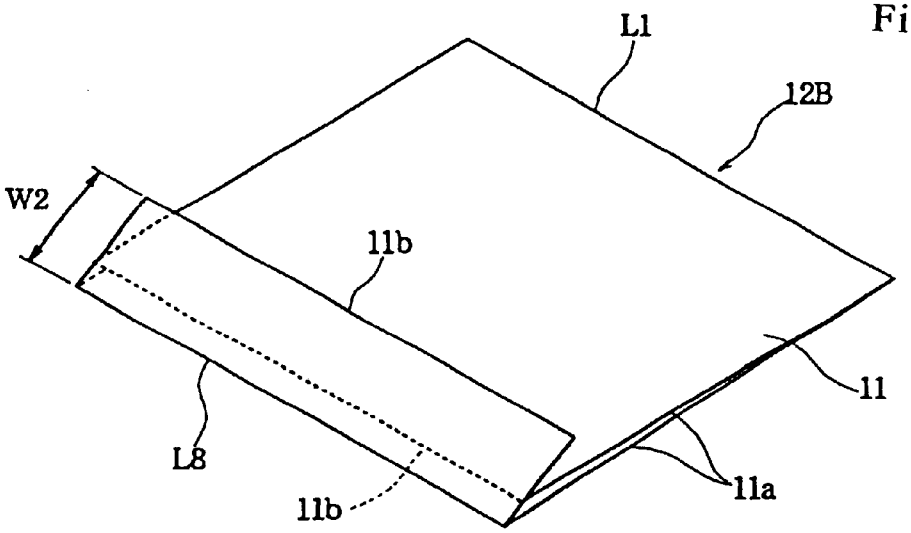

FIGS. 9(A) and 9(B) show modifications of the invention.

In FIG. 9(A), when the wet tissue 11 of FIG. 2(A) is folded on the first folding line L1, one half is made larger than the other half. This modified double-folded tissue is then folded on a seventh folding line L7 so that the side edges 11*b* and 11*b* are generally aligned with each other, to thereby obtain a folded tissue 12A. The width between the folding line L7 and the adjacent the side edge 11*b* is indicated by W1. This folded tissue 12A has one half or about one half of the area of the wet tissue 11 in the opened out state.

In FIG. 9(B), also, when the wet tissue 11 of FIG. 2(A) is folded on the first folding line L1, one half is made larger than the other half. In this case, however, the modified double-folded tissue is then folded on an eighth folding line L8 so that one side edge 11*b* is hidden under the folded portion including the other side edge 11*b* and having a width W2, to thereby obtain a folded tissue 12B. This folded tissue 12B has less than one half of the area of the wet tissue 11 in the opened out state.

Either the folded tissue 12A of FIG. 9(A) or the folded tissue 12B of FIG. 9(B) is further folded as in the steps of FIGS. 3(A) and 3(B), FIGS. 6(A) and 6(B) or FIGS. 8(A) and 8(B) to have a structure similar to that of the folded sheet 10, the folded sheet 20 or the folded sheet 30.

Such a folded sheet prepared by folding the folded tissue 12A or 12B on the second folding line L2, the third folding line L3, and the fourth folding line L4 (optionally, on the fifth folding line L5 and the sixth folding line L6) can also provide a compact structure. Moreover, it can be used for wiping immediately after pull-out while keeping the folded state of the folded tissue 12A or 12B to have about one half or less than one half of the original area of the wet tissue 11.

Here, the width W1 is preferably 2 to 5 mm, and the width W2 is preferably 2 to 30 mm.

In the present invention, a relation of "a">"b" is preferred when the absolute value of the difference between "a" and "b" is 30 mm or more, where the side edge parallel to the first folding line L1 has the length "b" and the side edge perpendicular to the same has the length "a", as shown in FIG. 2(A).

When the absolute value of the difference between "a" and "b" is less than 30 mm, on the other hand, any relation is acceptable, "a">"b", "a"<"b" and "a"="b".

With the size relations specified above, the folded sheet 10, 20 or 30 to be accommodated in the packaging material 1 can be made compact, and the folded sheet 12, 12A or 12B in the taken-out state is of an easily usable size.

Here, the packaging material 1 should not be limited to the bag shape but may be exemplified by a hard container or the like.

According to the invention, as has been described hereinbefore, the wet tissue can be folded compactly and can be used for wiping, when pulled out from the packaging material, in the folded state having about one half or less than one half of the area of the opened out state. Therefore, another folding is not required after the wet tissue is pulled out from the packaging material and the material to be cleaned hardly soils the hands in use.

In the foregoing specification, the invention has been described in relation to preferred embodiments and many details have been set forth for the purpose of illustration. It will be apparent to those skilled in the art that the invention is susceptible to additional embodiments and that certain of the details described herein can be varied considerably without departing from the basic principles of the invention.

What is claimed is:

1. A wet tissue package comprising a plurality of rectangular or square wet tissues which are individually folded and are stacked in a bag-shaped or container-shaped-packaging material of which an upper face is formed with an opening for taking out the wet tissues therethrough one by one, wherein each of the wet tissues is folded on a first folding line (L1) into a double-folded state, the double-folded wet tissue is folded on a second folding line (L2) so that the first folding line (L1) is laid over an upper side of the double-folded wet tissue; folded on a third folding line (L3) so that side edges (11*b*) opposed to the first folding line (L1) are laid over a back side of the double-folded wet tissue; and then folded on a fourth folding line (L4) perpendicular to the first folding line (L1) so that the back side becomes a valley side, and the wet tissue after being folded on the fourth folding line (L4) is accommodated in the packaging material with the upper side thereof directed toward the upper face of the packaging material so that the first folding line (L1) appearing on the upper side of the wet tissue is exposed in the opening of the packaging material.

2. A wet tissue package according to claim 1, wherein the double-folded wet tissue has substantially one half of the area of the wet tissue in its opened out state.

3. A wet tissue package according to claim 2, wherein in the wet tissue after being folded on the fourth folding line (L4), the first folding line (L1) is located substantially at a center between the second folding line (L2) and the third folding line (L3).

4. A wet tissue package according to claim 3, wherein in the wet tissue in the opened out state, a length (a) of the side edge (11*a*) perpendicular to the first folding line (L1) is longer than a length (b) of the side edge (11*b*) parallel to the first folding line (L1) by 30 mm or more.

5. A wet tissue package according to claim 3, wherein in the wet tissue in the opened out state, a length (a) of the side edge (11*a*) perpendicular to the first folding line (L1) is equal to or different from a length (b) of the side edge (11*b*) parallel to the first folding line (L1) within a range of less than 30 mm.

6. A wet tissue package according to claim 2, wherein a portion folded on the third folding line (L3) and laid over the back side is further folded on a fifth folding line (L5) so that the side edges (11*b*) are positioned below the third folding line (L3).

7. A wet tissue package according to claim 6, wherein in the wet tissue after being folded on the fourth folding line (L4), the first folding line (L1) is located substantially at a center between the second folding line (L2) and the third folding line (L3).

8. A wet tissue package according to claim 2, wherein the double-folded wet tissue is further folded prior to the folding on the second, third and fourth folding lines (L2, L3 and L4), such that either of two folded portions is folded on another folding line (L7 or L8), to thereby have at most one half of the area of the wet tissue in the opened out state.

9. A wet tissue package according to claim 8, wherein in the wet tissue after being folded on the fourth folding line (L4), the first folding line (L1) is located substantially at a center between the second folding line (L2) and the third folding line (L3).

10. A wet tissue package according to claim 9, wherein in the wet tissue in the opened out state, a length (a) of the side edge (11*a*) perpendicular to the first folding line (L1) is longer than a length (b) of the side edge (11*b*) parallel to the first folding line (L1) by 30 mm or more.

11. A wet tissue package according to claim 9, wherein in the wet tissue in the opened out state, a length (a) of the side edge (11*a*) perpendicular to the first folding line (L1) is equal to or different from a length (b) of the side edge (11*b*) parallel to the first folding line (L1) within a range of less than 30 mm.

12. A wet tissue package according to claim 8, wherein a portion folded on the third folding line (L3) and laid over the back side is further folded on a fifth folding line (L5).

13. A wet tissue package according to claim 12, wherein in the wet tissue after being folded on the fourth folding line (L4), the first folding line (L1) is located substantially at a center between the second folding line (L2) and the third folding line (L3).

14. A wet tissue package comprising a plurality of rectangular or square wet tissues which are individually folded and are stacked in a bag-shaped or container-shaped packaging material of which an upper face is formed with an opening for taking out the wet tissues therethrough one by one, wherein each of the wet tissues is folded on a first folding line (L1) into a double-folded state, the double-folded wet tissue is folded on a second folding line (L2) so that the first folding line (L1) is laid over an upper side of the double-folded wet tissue; folded on a sixth folding line (L6) located between the first folding line (L1) and the second folding line (L2) so that the first folding line (L1) is positioned above the second folding line (L2); folded on a third folding line (L3) so that side edges (11*b*) opposed to the first folding line (L1) are laid over a back side of the double-folded wet tissue; and then folded on a fourth folding line (L4) perpendicular to the first folding line (L1) so that the back side becomes a valley side, and the wet tissue after being folded on the fourth folding line (L4) is accommodated in the packaging material with the upper side thereof directed toward the upper face of the packaging material so that at least one of the first folding line (L1) and the sixth folding line (L6) appearing on the upper side of the wet tissue is exposed in the opening of the packaging material.

15. A wet tissue package according to claim 14, wherein the double-folded wet tissue has substantially one half of the area of the wet tissue in its opened out state.

16. A wet tissue package according to claim 15, wherein in the wet tissue after being folded on the fourth folding line (L4), the sixth folding line (L6) is located substantially at a center between the second folding line (L2) and the third folding line (L3).

17. A wet tissue package according to claim 16, wherein in the wet tissue in the opened out state, a length (a) of the side edge (11*a*) perpendicular to the first folding line (L1) is longer than a length (b) of the side edge (11*b*) parallel to the first folding line (L1) by 30 mm or more.

18. A wet tissue package according to claim 16, wherein in the wet tissue in the opened out state, a length (a) of the side edge (11*a*) perpendicular to the first folding line (L1) is equal to or different from a length (b) of the side edge (11*b*) parallel to the first folding line (L1) within a range of less than 30 mm.

19. A wet tissue package according to claim 15, wherein a portion folded on the third folding line (L3) and laid over the back side is further folded on a fifth folding line (L5) so that the side edges (11*b*) are positioned below the third folding line (L3).

20. A wet tissue package according to claim 19, wherein in the wet tissue after being folded on the fourth folding line (L4), the sixth folding line (L6) is located substantially at a center between the second folding line (L2) and the third folding line (L3).

21. A wet tissue package according to claim 15, wherein the double-folded wet tissue is further folded prior to the folding on the second, third and fourth folding lines (L2, L3 and L4), such that either of two folded portions is folded on another folding line (L7 or L8), to thereby have at most one half of the area of the wet tissue in the opened out state.

22. A wet tissue package according to claim 21, wherein in the wet tissue after being folded on the fourth folding line (L4), the sixth folding line (L6) is located substantially at a center between the second folding line (L2) and the third folding line (L3).

23. A wet tissue package according to claim 22, wherein in the wet tissue in the opened out state, a length (a) of the side edge (11*a*) perpendicular to the first folding line (L1) is longer than a length (b) of the side edge (11*b*) parallel to the first folding line (L1) by 30 mm or more.

24. A wet tissue package according to claim 22, wherein in the wet tissue in the opened out state, a length (a) of the side edge (11*a*) perpendicular to the first folding line (L1) is equal to or different from a length (b) of the side edge (11*b*) parallel to the first folding line (L1) within a range of less than 30 mm.

25. A wet tissue package according to claim 21, wherein a portion folded on the third folding line (L3) and laid over the back side is further folded on a fifth folding line (L5).

26. A wet tissue package according to claim 25, wherein in the wet tissue after being folded on the fourth folding line (L4), the first folding line (L1) is located substantially at a center between the second folding line (L2) and the third folding line (L3).

* * * * *

UNITED STATES PATENT AND TRADEMARK OFFICE

CERTIFICATE OF CORRECTION

PATENT NO. : 6,296,144 B1
DATED : October 2, 2001
INVENTOR(S) : Yoshikazu Tanaka and Mitsuko Yamaji It is certified that error appears in the above-identified patent and that said Letters Patent is hereby corrected as shown below:

Title page,
Item [73], Assignee, change "Kawanoe (JP)" to -- Ehime (JP) --.

Signed and Sealed this

Ninth Day of July, 2002

*Attest:*

*Attesting Officer*

JAMES E. ROGAN
*Director of the United States Patent and Trademark Office*